US009097263B2

(12) United States Patent
Adhvaryu et al.

(10) Patent No.: US 9,097,263 B2
(45) Date of Patent: Aug. 4, 2015

(54) INLET DESIGN FOR A PUMP ASSEMBLY

(75) Inventors: Ketan G. Adhvaryu, Sterling Heights, MI (US); Murray Busato, Clinton Township, MI (US); Robert D. Keefover, Lake Orion, MI (US); Brian M. Chomicz, St. Clair Shores, MI (US)

(73) Assignee: BorgWarner Inc., Auburn Hills, MI (US)

( * ) Notice: Subject to any disclaimer, the term of this patent is extended or adjusted under 35 U.S.C. 154(b) by 695 days.

(21) Appl. No.: 13/363,946

(22) Filed: Feb. 1, 2012

(65) Prior Publication Data

US 2013/0195607 A1 Aug. 1, 2013

(51) Int. Cl.
*F04D 29/40* (2006.01)
*F04D 23/00* (2006.01)

(52) U.S. Cl.
CPC ..... *F04D 29/403* (2013.01); *F04D 23/008* (2013.01)

(58) Field of Classification Search
CPC ..... F04D 5/002; F04D 5/007; F04D 23/008; F04D 29/701; F04D 29/441; F04D 29/4213; F05B 2250/503; F05B 2250/50; F05B 2250/501
USPC ..... 415/1, 52.1, 55.1, 55.2, 55.3, 55.4, 415/58.2, 58.3, 184
See application file for complete search history.

(56) References Cited

U.S. PATENT DOCUMENTS

| | | | | | |
|---|---|---|---|---|---|
| 2,056,553 | A * | 10/1936 | Abramson | 415/184 |
| 2,321,810 | A * | 6/1943 | Gurley | 415/87 |
| 2,724,338 | A * | 11/1955 | Roth | 415/55.5 |
| 2,842,062 | A * | 7/1958 | Wright | 415/11 |
| 4,306,833 | A * | 12/1981 | Sixsmith et al. | 415/55.4 |
| 4,408,952 | A * | 10/1983 | Schweinfurter | 415/55.6 |
| 7,033,137 | B2 * | 4/2006 | Shufeldt | 415/119 |
| 7,513,741 | B2 * | 4/2009 | Smiley et al. | 415/205 |
| 2004/0096316 | A1 * | 5/2004 | Simon et al. | 415/151 |
| 2010/0086396 | A1 | 4/2010 | Peterson et al. | |
| 2010/0172777 | A1 | 7/2010 | Adhvaryu et al. | |
| 2010/0272562 | A1 * | 10/2010 | Hammar et al. | 415/204 |

OTHER PUBLICATIONS

U.S. Appl. No. 13/363,922, filed Feb. 1, 2012 ; Title: Inlet Design for a Pump Assembly ; Inventors : Ketan G.Adhvaryu, Murray Busato, Robert D. Keefover, Brian M. Chomicz.

* cited by examiner

*Primary Examiner* — Nathaniel Wiehe
*Assistant Examiner* — Eldon Brockman
(74) *Attorney, Agent, or Firm* — BrooksGroup

(57) ABSTRACT

One embodiment includes an air pump assembly (10) with an impeller (12), a housing (16), and a diverter (18). The housing (16) surrounds the impeller (12) and has an inlet passage (40) with a longitudinal axis (L) arranged generally non-orthogonally with respect to an axis of rotation of the impeller (12). The diverter (18) helps reduce turbulent flow in the inlet passage (40).

12 Claims, 6 Drawing Sheets

INLET DESIGN FOR A PUMP ASSEMBLY

TECHNICAL FIELD

The technical field generally relates to inlet designs for pump assemblies.

BACKGROUND

Pump assemblies having impellers are sometimes designed with an inlet passage that feeds fluid to the impeller. One example of such a pump assembly is a secondary air pump assembly that supplies secondary or intake air to an automotive exhaust system during warm-up of an automotive internal combustion engine, or at other times.

SUMMARY OF ILLUSTRATIVE EMBODIMENTS

One embodiment includes an air pump assembly that may include an impeller, a housing, and a diverter. The impeller may have an axial face and a circumferential periphery. The housing may surround the impeller. The housing may form a part or more of a primary passage for air flow during use of the air pump assembly. The primary passage may be open to the impeller at the axial face of the impeller. The housing may have an inlet passage that may communicate with the primary passage. The inlet passage may have a longitudinal axis that may be arranged generally non-orthogonally with respect to an axis of rotation of the impeller. The diverter may be located partially or more within the inlet passage. The diverter may have a surface that may confront the axial face of the impeller, may confront the circumferential periphery of the impeller, or may confront both the axial face and the circumferential periphery. When the air pump assembly is in use, the diverter may inhibit generation of turbulent flow between incoming air flow and the impeller where the surface confronts the impeller.

One embodiment includes a method. The method may include providing an air pump assembly that may comprise an impeller and a housing. The impeller may have numerous vanes and an axial face. The vanes may have a circumferential periphery. The housing may form a part or more of a primary passage. The primary passage may be open to the vanes at the axial face. The housing may have an inlet passage that may communicate with the primary passage. The inlet passage may have a longitudinal axis that may be arranged generally axially with respect to the impeller. The method may also include diverting a portion or more of incoming air flow through the inlet passage away from the axial face of the impeller, away from the circumferential periphery of the vanes, or away from both the axial face and circumferential periphery.

One embodiment includes an air pump assembly that may include an impeller, a motor, a housing, and a diverter. The impeller may have numerous vanes, a first axial face, and a second axial face. The vanes may have a circumferential periphery. The motor may be connected to the impeller in order to rotate the impeller during use of the air pump assembly. The housing may surround the impeller. The housing may form a part or more of a first primary passage and a part or more of a second primary passage. The first primary passage may be open to the vanes at the first axial face, and the second primary passage may be open to the vanes at the second axial face. The housing may have an inlet passage that may communicate with the first and second primary passages. The inlet passage may have a longitudinal axis that may be arranged generally axially with respect to the impeller. The diverter may have a surface that may confront a portion or more of the axial extent of the circumferential periphery of the vanes via a radial space, may confront a portion or more of the radial extent of the vanes via an axial space, or may confront both the circumferential periphery and the vanes.

Other illustrative embodiments of the invention will become apparent from the detailed description provided hereinafter. It should be understood that the detailed description and specific examples, while disclosing illustrative embodiments of the invention, are intended for purposes of illustration only and are not intended to limit the scope of the invention.

BRIEF DESCRIPTION OF THE DRAWINGS

Illustrative embodiments of the present disclosure will become more fully understood from the detailed description and the accompanying drawings, wherein.

DETAILED DESCRIPTION OF ILLUSTRATIVE EMBODIMENTS

The following description of the embodiment(s) is merely illustrative in nature and is in no way intended to limit the invention, its application, or its uses.

The figures illustrate several embodiments of an inlet design for a pump assembly that may improve fluid-flow efficiencies in the pump assembly compared to known inlet designs, meaning that the inlet designs disclosed herein may produce greater volumetric flow rate for a given power input. The overall size of the pump assembly may therefore be reduced if suitable and desirable for a particular application, while maintaining the same fluid-flow performance of the larger pump assembly with the known inlet design. Of course, the overall size of the pump assembly with the inlet designs disclosed herein need not be reduced, in which case the pump assembly would simply exhibit improved fluid-flow efficiencies and improved performance. The improvements may result in part from a reduction in turbulence of incoming fluid-flow, as will be described in greater detail below.

Figure 1:
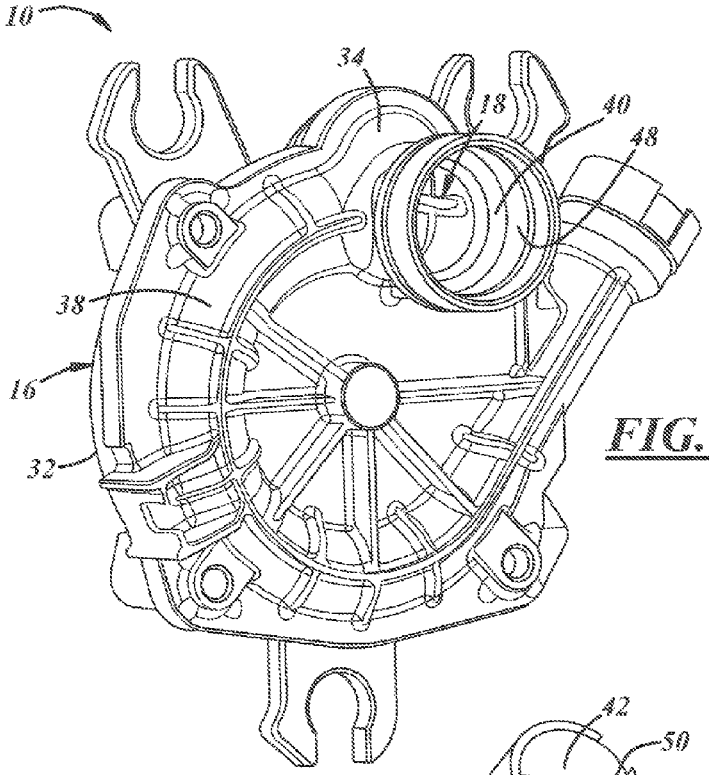
FIG. 1 is a top perspective view of an embodiment of an air pump assembly.
Figure 2:
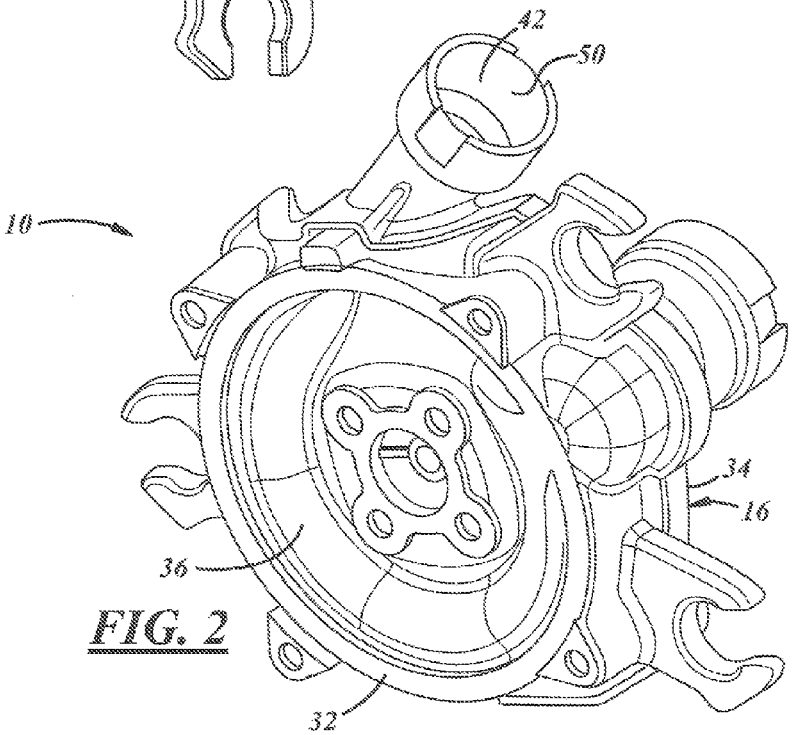
FIG. 2 is a bottom perspective view of the air pump assembly of FIG. 1.

Referring to FIG. 1, the inlet designs described herein may be incorporated into a pump assembly 10. In the embodiments shown in the figures, the pump assembly 10 may be a secondary air pump assembly that is used in a secondary air system of an automotive internal combustion engine exhaust system. Secondary air systems are equipped in engine exhaust systems of automotive internal combustion engines in order to supply intake air to the engines during warm-up modes, during other engine modes, or both. Depending upon the particular application, other components of secondary air systems may include an air filter, an air valve, a catalytic converter, a diesel particulate filter, or a combination thereof. Skilled artisans will understand the general construction, arrangement, and operation of these components and others of secondary air systems such that a more detailed description need not be provided here.

The pump assembly 10 may be of the regenerative pump type. Referring to FIGS. 1-6, in the illustrated embodiment, the pump assembly 10 may include an impeller 12, a motor 14, a housing 16, and a diverter 18.

Figure 3:
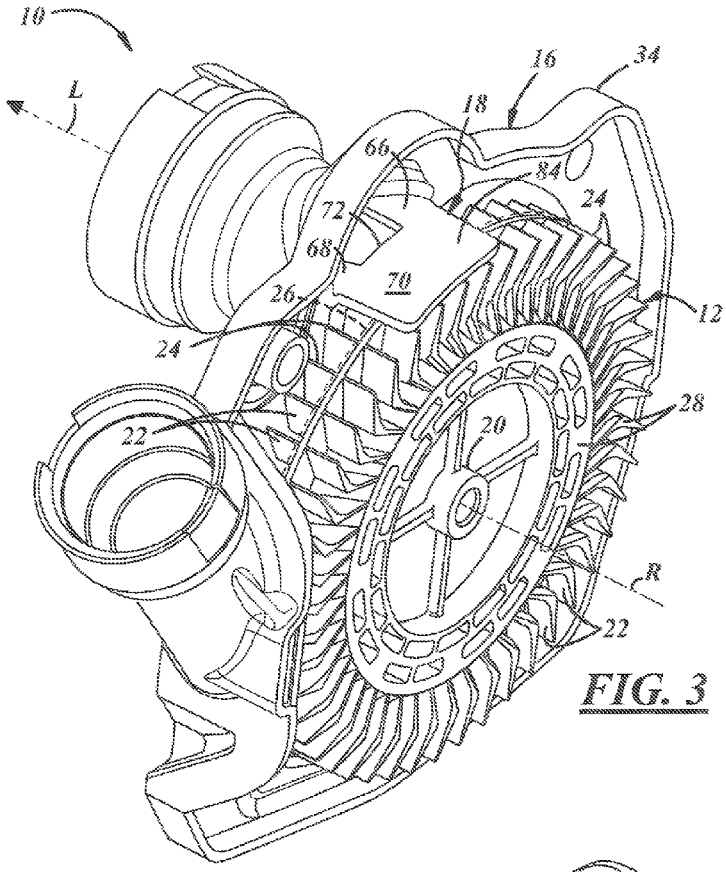
FIG. 3 is a perspective view of the air pump assembly of FIG. 1 with a body removed to show an impeller.
Figure 4:
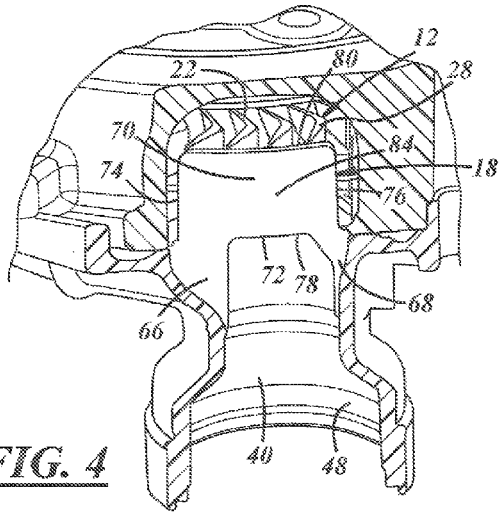
FIG. 4 is a cross-sectional view of an inlet of the air pump assembly of FIG. 1.
Figure 5:
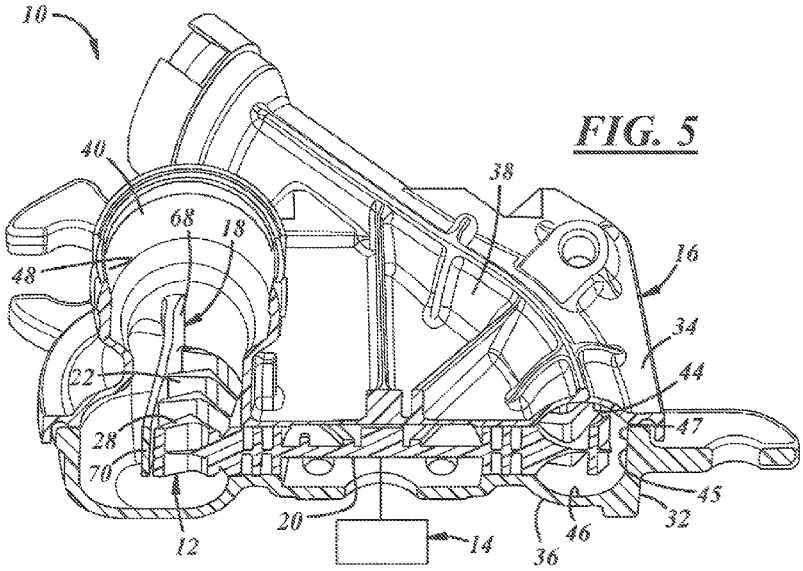
FIG. 5 is a cross-sectional view of the air pump assembly of FIG. 1.

Referring in particular to FIG. 3 where a part of the housing 16 is removed for demonstrative purposes, the impeller 12 may be located in the housing and may be rotated by the motor 14 about an axis of rotation R during use of the pump assembly 10. Generally speaking, the impeller 12 may have a somewhat cylindrical shape that defines directions with respect to the shape including a radial direction, an axial direction, and a circumferential direction; as used herein, and unless otherwise specified, the terms radially, axially, circumferentially, and variants thereof, are in reference to the shape of the impeller. The impeller 12 may have different designs and constructions, including that shown in FIGS. 3 and 5. In these figures, the impeller 12 has a body which may have a hub 20 and numerous vanes 22 extending radially outwardly from the hub. The hub 20 may be constructed for connection to a spinning shaft of the motor 14. The vanes 22 may extend circumferentially all-around the hub 20, and may each have a terminal end 24 at a radially-outwardly-most point of the vane. A circumferential periphery 26 may be an imaginary radially-outwardly-most circumference of the impeller 12, and in this embodiment may be defined in part by the terminal ends 24 of the vanes 22. The circumferential periphery 26 may have an axial height dimension A (FIG. 6) which, in this embodiment, is also the axial height dimension of the vanes 22 and of the impeller 12. Lastly, the impeller 12 may also have a first axial face 28 and a second axial face 30. The first and second axial faces 28, 30 may be defined by planar surfaces located at opposite axially-outwardly-most ends of the impeller 12.

The motor 14 may be located outside of the housing 16 and may be mounted to the housing, and may be connected to the impeller 12 in order to provide rotational drive thereto via its spinning shaft. The motor 14 is shown schematically in FIG. 5. The motor 14 may be an electric d.c. motor, or may be another type.

The housing 16 may provide structural support for components of the pump assembly 10. The housing 16 may have different designs and constructions, including that shown in FIGS. 1-6. In these figures, the housing 16 may be composed of separate and distinct pieces that are attached together via fasteners, welding, heat staking, or other attachment ways. The pieces may be made of a plastic material, and may be formed by injection molding processes. The housing 16 may include a body piece 32 and a cover piece 34; in other embodiments, for example, a separate inlet piece could be provided, and a separate outlet piece could also be provided. The body piece 32 may have a first bulged portion 36 that partly defines a fluid-flow passage, as discussed below, and likewise the cover piece 34 may have a second bulged portion 38 that partly defines a fluid-flow passage.

Figure 6:
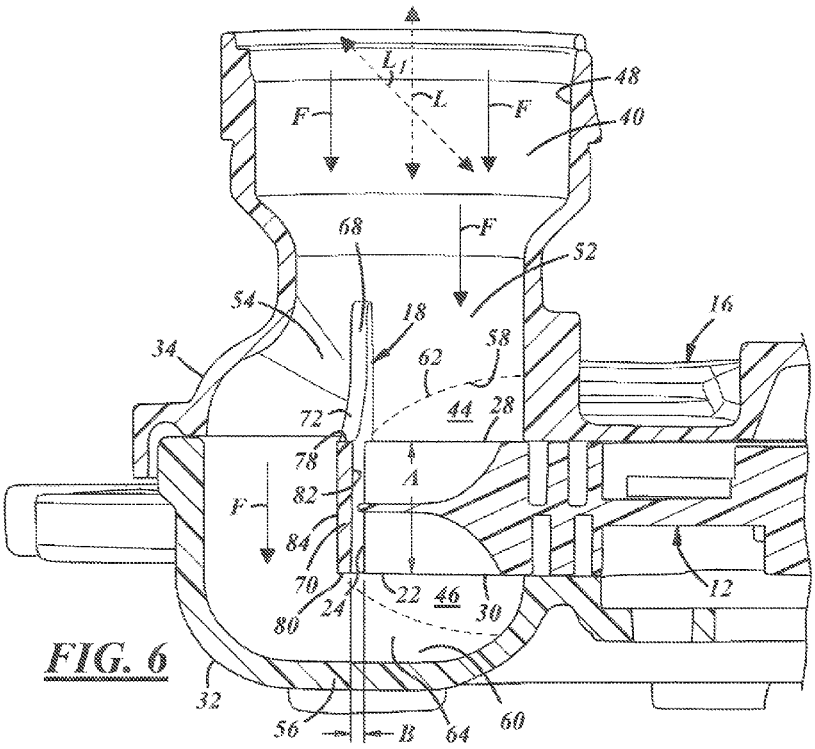
FIG. 6 is a cross-sectional view of an inlet of the air pump assembly of FIG. 1.

Furthermore, and as mentioned, the housing 16 may partly define fluid-flow passages of the pump assembly 10. Still referring to FIGS. 1-6, the housing 16 may have an inlet passage 40, an outlet passage 42, and a first and second primary passage 44, 46 communicating between the inlet and outlet passages (the first and second primary passages are shown somewhat schematically in FIG. 6 for description purposes). In other embodiments not shown in the figures, the housing could have a single primary passage instead of two, and could have two inlet passages such as a housing inlet passage arranged generally radially and a cover inlet passage arranged generally axially as disclosed in United States Patent Application Publication Number 2010/0086396 assigned to this applicant BorgWarner Inc. The inlet passage 40 may receive incoming fluid-flow and may be defined by an inlet surface 48. The inlet passage 40 may have a generally cylindrical shape, and in one example may have a diameter dimension of approximately 20 mm; other diameter dimensions are possible and may depend on, among other factors, the particular application. In the embodiment of FIG. 6, the inlet passage 40 may have a longitudinal axis L that may be arranged generally axially with respect to the impeller 12 and may be parallel to the axis of rotation R of the impeller. The axial arrangement of the inlet passage 40 need not be exact axial arrangement with respect to the impeller 12, and instead the longitudinal axis L may intersect an imaginary radius of the impeller at an angle that is slightly greater than or less than ninety degrees and is thus generally orthogonal to the imaginary radius. The longitudinal axis L may be arranged non-orthogonally with respect to the axis of rotation R of the impeller 12; in other words, the inlet passage 40 does not direct incoming fluid-flow F radially with respect to the impeller. The inlet passage 40 may direct incoming fluid-flow F somewhat at the axial face of the impeller 12 and not directly at the circumferential periphery 26. For example, the inlet passage 40 may direct incoming fluid-flow F at approximately a forty-five degree angle with respect to the axis of rotation R; this is represented in FIG. 6 by a longitudinal axis $L_1$. Other angles greater than or less than forty-five degrees are possible. In FIG. 6, incoming fluid-flow F travels from top to bottom in the inlet passage 40. The outlet passage 42 may carry outgoing fluid-flow expelled out of the pump assembly 10, and may communicate with the first and second primary passages 44, 46 at a location downstream that at which the inlet passage 40 communicates with the first and second primary passages. The outlet passage 42 may be defined by an outlet surface 50, and, like the inlet passage 40, may have a generally cylindrical shape.

In this illustrated embodiment of the pump assembly 10, the inlet passage 40 may include a first inlet passage 52 and a second inlet passage 54. The first and second inlet passages 52, 54 may be defined in part by the diverter 18. The first inlet passage 52 may communicate with the first primary passage 44, and the second inlet passage 54 may communicate with the second primary passage 46. The first inlet passage 52 may direct incoming fluid-flow generally toward the first axial face 28 of the impeller 12 at the location of the vanes 22, and generally toward the first primary passage 44; and the second inlet passage 54 may direct incoming fluid-flow generally toward the second axial face 30 of the impeller at the location of the vanes and generally toward the second primary passage 46. Referring in particular to FIG. 6, fluid-flow in the first inlet passage 52 may flow in the general axial direction, while fluid-flow in the second inlet passage 54 may flow along a more circuitous path. Fluid-flow in the second inlet passage 54 may travel axially past the impeller 12, may impinge the inlet surface 48 at a closed bottom 56 ("bottom" relative to the orientation of FIG. 6) of the inlet passage, and may be deflected toward the second primary passage 46.

The first and second primary passages 44, 46 may carry fluid-flow through the pump assembly 10 as the fluid-flow travels from the inlet passage 40 and to the outlet passage 42. Referring to FIG. 6, the first primary passage 44 may be defined in part by a first primary surface 58 that, in this embodiment, may be located in the cover piece 34 and may be formed by the second bulged portion 38. The first axial face 28 of the impeller 12 may also define a part of the first primary passage 44. Similarly, the second primary passage 46 may be defined in part by a second primary surface 60 that, in this embodiment, may be located in the body piece 32 and may be formed by the first bulged portion 36. The second axial face 30 of the impeller 12 may also define a part of the second primary passage 46. The first and second primary passages 44, 46 may communicate with each other and exchange fluid-flow via an axial passage 45 shown best in FIG. 5. The axial passage 45 may be defined in part by a side wall 47 of the housing 16 and by the circumferential periphery 26 of the impeller 12, and may extend circumferentially around the housing between the inlet passage 40 and the outlet passage 42. In cross-sectional profile like that shown in FIG. 6, each of the first and second primary passages 44, 46 may have a generally half-circle shape. From the inlet passage 40 to the outlet passage 42, each of the first and second primary passages 44, 46 may have an abridged generally half-torus shape. The inlet passage 40 may initially communicate with the first primary passage 44 at a first entrance 62, and the inlet passage may initially communicate with the second primary passage 46 at a second entrance 64. The first and second primary passages 44, 46 may each be open to the vanes 22 so that the first and second primary passages can communicate with the spaces located between neighboring individual vanes.

The diverter 18 may be a structure that may be used to veer, obstruct, or both veer and obstruct fluid-flow traveling through the inlet passage 40. In the case of an air pump assembly, air flow may principally make its way into the spaces located between neighboring individual vanes 22 via the first and second primary passages 44, 46 at the first and second axial faces 28, 30 of the impeller 12. It has been found that turbulent flow may be generated by initial impingement between incoming fluid-flow and the terminal ends 24 of the rotating vanes 22, and between incoming fluid-flow and the axial faces 28, 30 of the rotating impeller 12 at the location of the vanes. The turbulent flow may spread beyond the immediate region of initial impingement, and may interfere with and impede fluid-flow traveling in the first inlet passage 52 entering the first primary passage 44, may interfere with and impede fluid-flow in the second inlet passage 54 traveling axially past the impeller 12, may interfere with or impede fluid-flow traveling in the second inlet passage entering the second primary passage 46, or a combination thereof. The diverter 18 may therefore veer fluid-flow away from impingement with the vanes 22 and/or axial faces 28, 30, may be an obstruction to impingement, or both, to thereby limit or altogether eliminate turbulent flow otherwise generated thereat. Fluid-flow may then travel through the inlet passage 40 and into the first and second primary passages 44, 46 with greater ease, yielding improved fluid-flow efficiencies by as much as approximately eleven percent over some known inlet designs without diverters; fluid-flow improvements greater than eleven percent may also be possible.

The diverter 18 may have different designs and constructions, including that shown by a first embodiment in FIGS. 3-6. The diverter 18 may be made of a plastic material, and may be formed by an injection molding process. The diverter 18 may be located in the inlet passage 40, and may be attached to or extend from the inlet surface 48, or may be attached to or extend from the body piece 32 or the cover piece 34. In the first embodiment, the diverter 18 may have a longitudinal axis that may be in general alignment and parallel to the longitudinal axis L of the inlet passage 40. In the inlet passage 40, the diverter 18 may be positioned so that it does not directly obstruct the entrances 62, 64 from fluid-flow entering into the first and second primary passages 44, 46.

Referring to FIGS. 3-6, in the first embodiment the diverter 18 may have a generally U-shape with a first attachment, extension, or leg portion 66; a second attachment, extension, or leg portion 68; a confrontation or base portion 70 extending therebetween; and an opening 72 defined partly by the portions. Between the first and second leg portions 66, 68, the diverter 18 may have a circumferential width dimension that may be approximately equal to the diameter of the inlet passage 40 measured thereat. The first leg portion 66 may be attached to or may extend from the inlet surface 48 on one side thereof at the cover piece 34, and the second leg portion 68 may be attached to or may extend from the inlet surface at the opposite side thereof at the cover piece. The base portion 70 may be suspended axially from the cover piece 34 and, in assembly, may generally directly confront and oppose the terminal ends 24 of the vanes 22 and the circumferential periphery 26 of the impeller 12. The base portion 70 may have a first circumferential end 74, a second circumferential end 76, a first axial end 78, and a second axial end 80. Between the first and second circumferential ends 74, 76, the base portion 70 may have a circumferential width that may generally and substantially span the circumferential extent of the second inlet passage 54 so that bypassing fluid-flow F in the second inlet passage may not impinge the terminal ends 24 of the rotating vanes 22. And between the first and second axial ends 78, 80, the base portion 70 may have an axial height that may generally and substantially span the full axial extent of the vanes 22 and may be approximately equal to the axial height dimension A of the circumferential periphery 26, again so that bypassing fluid-flow F in the second inlet passage 54 may not impinge the terminal ends 24 of the rotating vanes. In other embodiments, both the circumferential width and the axial height of the base portion 70 may vary and may be greater than or less than the respective circumferential extent of the second inlet passage 54 and the axial height dimension A; in some applications and circumstances, it may be suitable to have some fluid-flow impinge the terminal ends 24 of the vanes 22 during use.

Further, the diverter 18 may have an inner or confrontation surface 82, and may have an outer surface 84 located at an opposite radial side of the diverter. The outer surface 84 may directly face bypassing fluid-flow F in the second inlet passage 54. The confrontation surface 82, on the other hand, may directly confront the terminal ends 24 of the vanes 22 and the circumferential periphery 26 via a radial space. The radial space may have a radial length B that may be maintained at a constant value along its axial extent between the first and second axial ends 78, 80, and may be maintained at a constant value along its circumferential extent between the first and second circumferential ends 74, 76 in which case the confrontation surface. may have a bowed and curved profile that follows the profile of the circumferential periphery 26. In another embodiment, for example, the confrontation surface 82 may be generally planar in which case the radial length B has a greater value at the first and second circumferential ends 74, 76 than at a circumferential centerpoint between the first and second circumferential ends. The radial length B may have a value that may be less than a radial thickness value of the diverter 18, and, in one example, the radial length B may be approximately 0.6 mm or 1.0 mm; in other examples, other values for the radial length B are possible including values less than 0.6 mm, greater than 1.0 mm, or between 0.6 mm and 1.0 mm. As shown best in FIG. 6, the confrontation surface 82 may be arranged generally axially. Lastly, the confrontation surface 82, the circumferential periphery 26, and the radial space therebetween may constitute a confrontation region between the impeller 12 and the diverter 18.

In use, fluid-flow F is drawn into the inlet passage 40 via the rotating impeller 12. A portion of the incoming fluid-flow F may be drawn into the first inlet passage 52 and may enter the first primary passage 44, and a portion of the incoming fluid-flow F may be drawn into the second inlet passage 54 and may enter the second primary passage 46. Also, a portion of the incoming fluid-flow F may pass through the opening 72 between the first and second inlet passages 52, 54. In the second inlet passage 54, bypassing fluid-flow F opposes the outer surface 84 of the diverter 18 as the fluid-flow makes its way to the second primary passage 46. Because the diverter 18—and in particular the confrontation surface 82—may obstruct impingement between the bypassing fluid-flow F in the second inlet passage 54 and the terminal ends 24 of the vanes 22, turbulent flow may be limited or altogether eliminated. The fluid-flow may therefore be substantially free to travel past the impeller 12 toward the closed bottom 56 substantially unimpeded by turbulent flow that would otherwise be generated without use of the diverter 18.

Figure 7:
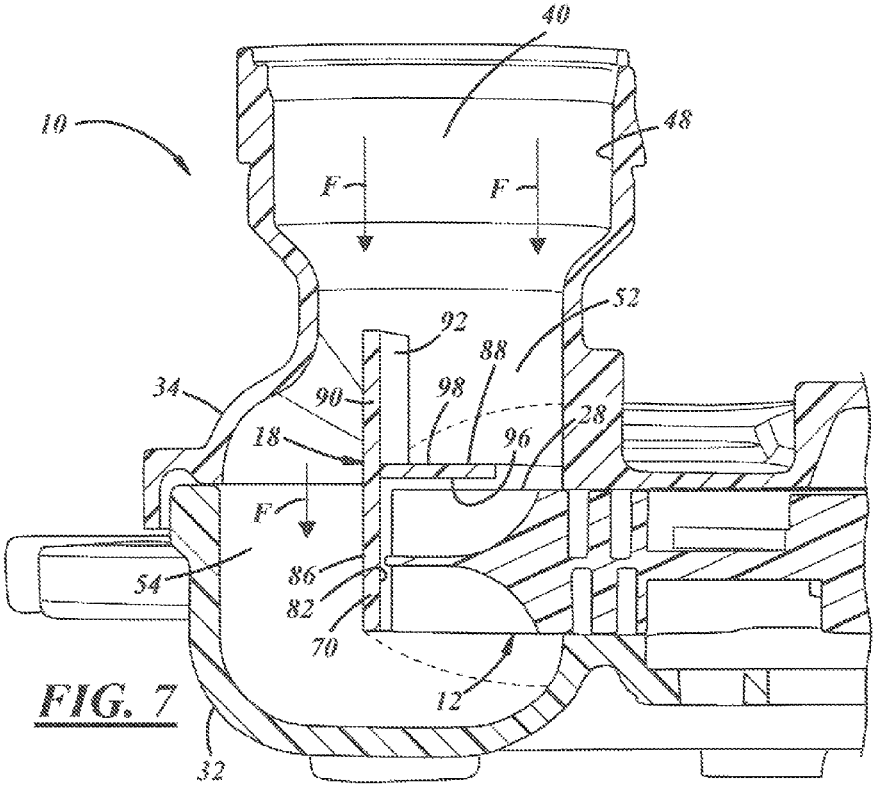
FIG. 7 is a cross-sectional view similar to that of FIG. 6, showing an embodiment of a diverter.
Figure 8:
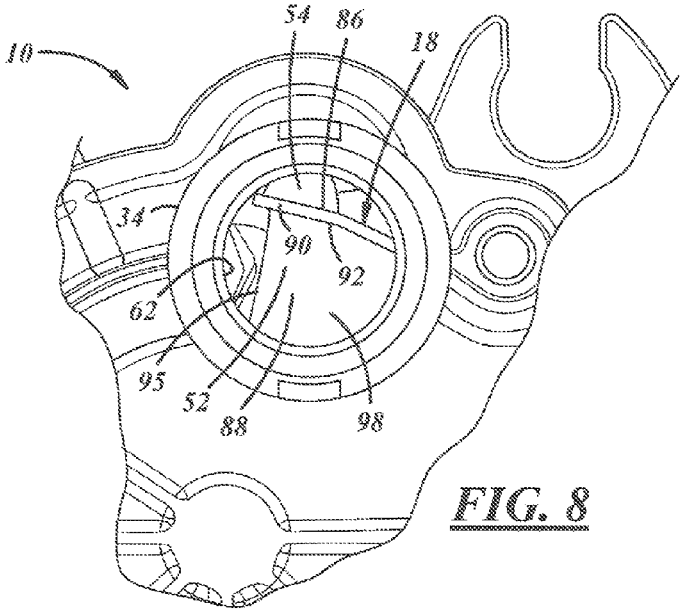
FIG. 8 is a top view of the diverter of FIG. 7.
Figure 9:
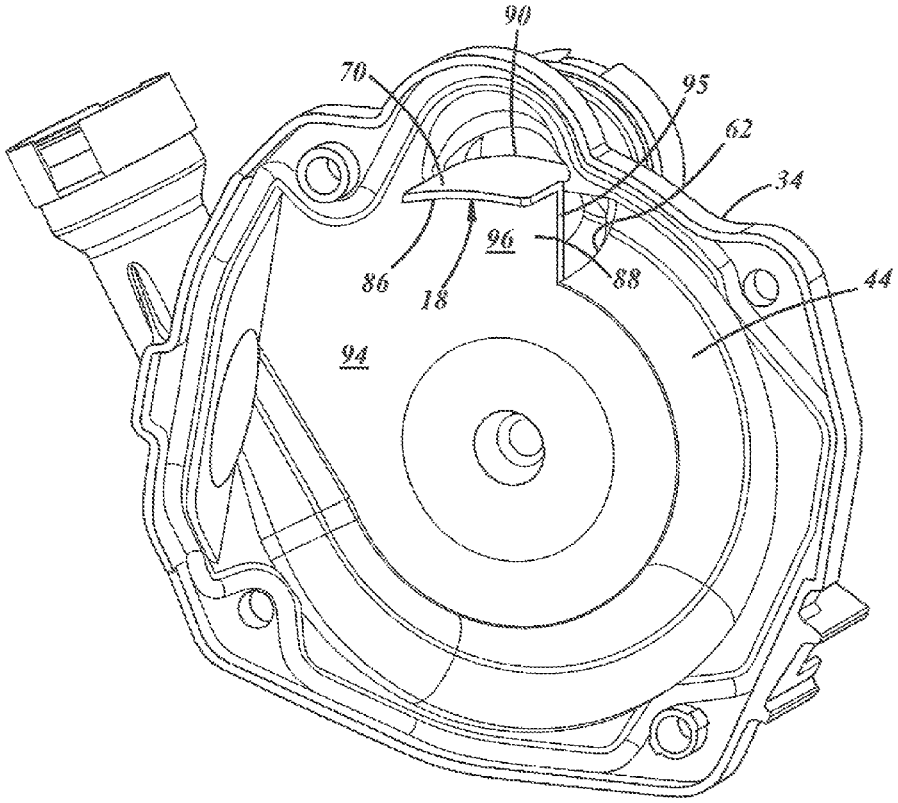
FIG. 9 is a bottom perspective view of a cover, showing the diverter of FIG. 7.

FIGS. 7-9 show a second embodiment of the pump assembly 10. The second embodiment is similar to the first embodiment in many ways, and the similarities may not necessarily be repeated here for the second embodiment. One difference is the diverter 18. In the second embodiment, the diverter 18 may include a first diverter 86 and a second diverter 88. The first diverter 86 may be attached to or extend from the inlet surface 48, may be attached to or extend from the body piece 32 or the cover piece 34, or need not be attached to surfaces or pieces and instead may be attached to or extend from the second diverter 88 unattached to other structures. In the second embodiment, the first diverter 86 may have a generally rectangular shape and—unlike the diverter 18 in the first embodiment—may not have the opening 72 and may instead have an extended portion 90. The extended portion 90 may have a circumferential width that may generally and substantially span the circumferential extent of the inlet passage 40. The extended portion 90 may have an inner surface 92. In use, the extended portion 90, and in particular the inner surface 92, may obstruct turbulence that may be generated between incoming fluid-flow F in the first inlet passage 52 and the first axial face 28 from spreading to the second inlet passage 54, though this may be suitable in some applications and circumstances. Accordingly, bypassing fluid-flow F in the second inlet passage 54 travelling axially past the impeller 12 may not be interfered with or impeded by the spreading turbulence. Of course, as described below, turbulent flow in the first inlet passage 52 at the first axial face 28 may be limited or altogether eliminated by the second diverter 88, such that in one embodiment the extended portion 90 may not be provided and instead the first diverter 86 may have the first and second leg portions and the opening as shown and described in the first embodiment. Furthermore, in other embodiments, the second diverter 88 may not be provided, whereby the first diverter 86 may be provided with the extended portion 90 alone. In this second embodiment, the first diverter 86 may have a first confrontation portion 70 and a first confrontation surface 82, as previously described in the first embodiment.

The second diverter 88 may be attached to or may extend from the cover piece 34—the attachment or extension is shown best in FIG. 9 which shows the second diverter extending from a planar underside surface 94 of the cover piece 34. In assembly, the underside surface 94 may directly confront the impeller 12. The second diverter 88 may be located adjacent the first entrance 62 of the first primary passage 44. The second diverter 88 may be arranged generally radially, while the first diverter 86 may be arranged generally axially such that the first and second diverters have an orthogonal relationship with respect to each other. The second diverter 88 may generally directly confront and oppose the first axial face 28 of the impeller 12; in particular, the second diverter may span a portion or more of the radial extent of the vanes 22 so that the second diverter may, in a sense, radially overlap the vanes. As shown in FIG. 8, the second diverter 88 may have a circumferential width that may be less than the diameter of the inlet passage 40 to leave a circumferential space between a circumferential end 95 of the second diverter and a wall of the cover piece 34; in another embodiment, the circumferential width may be approximately equal to the diameter of the inlet passage. The circumferential end 95 may partly define the first entrance 62. Further, the second diverter 88 may have a second confrontation surface 96 and an outer surface 98. The outer surface 98 may directly face incoming fluid-flow F in the first inlet passage 52. The second confrontation surface 96, on the other hand, may directly confront the first axial face 28 of the impeller 12 via an axial space. The axial space may have a value of approximately 0.35 mm, 0.6 mm, 1.0 mm, or some other value more, less, or in between these values. In use, the second confrontation surface 96 may obstruct impingement between incoming fluid-flow F and the first axial face 28 of the impeller 12 at the rotating vanes 22. Turbulent flow may therefore be limited or altogether eliminated thereat, and incoming fluid-flow F may enter the first primary passage 44 substantially unimpeded by the turbulent flow that would otherwise be generated without the use of the second diverter 88. The functionality of the first diverter 86 with respect to turbulent flow has been previously described.

Figure 10:
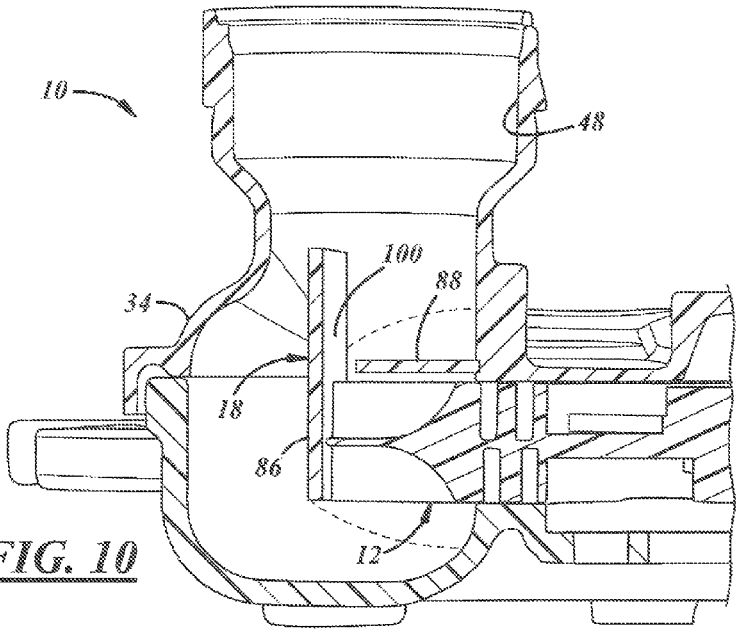
FIG. 10 is a cross-sectional view similar to that of FIG. 6, showing an embodiment of a diverter.

FIG. 10 shows a third embodiment of the pump assembly 10. The third embodiment is similar to the second embodiment in many ways, and the similarities may not necessarily be repeated here for the second embodiment. One difference is the second diverter 88. The second diverter 88 may be a separate and distinct piece from that of the first diverter 86, and the second and first diverters may be spaced from each other via a radial space 100. Like the second embodiment, the second diverter 88 may be attached to or may extend from the cover piece 34. And like the first embodiment, the first diverter 86 may be attached to or may extend from the inlet surface 48 on one side or both sides thereof at the cover piece 34.

Figure 11:
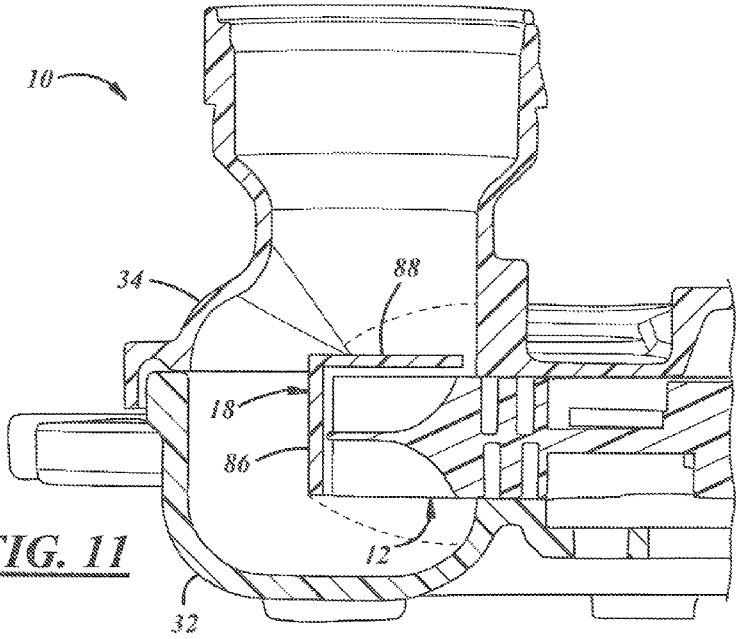
FIG. 11 is a cross-sectional view similar to that of FIG. 6, showing an embodiment of a diverter.

FIG. 11 shows a fourth embodiment of the pump assembly 10. The fourth embodiment is similar to the second embodiment in many ways, and the similarities may not necessarily be repeated here for the second embodiment. One difference is the first diverter 86. The first diverter 86 may not have the extended portion 90 of the second embodiment. In this embodiment, the first diverter 86 may extend from the second diverter 88, and the first diverter may not necessarily be otherwise attached to the cover piece 34 or the body piece 32.

Other embodiments—some of which have already been mentioned—that have not been described or shown are possible. For example, in any one of the first, second, third, or fourth embodiments, a third diverter could be provided. The third diverter could be located adjacent the second entrance of the second primary passage, could be arranged generally radially, and could generally directly confront and oppose the second axial face of the impeller to thereby limit or altogether eliminate generation of turbulent flow thereat. In another example, the diverter in any one of the embodiments could be attached to or could extend from the body piece instead or in addition to the cover piece.

The following is a description of select illustrative embodiments within the scope of the invention. The invention is not, however, limited to this description; and each embodiment and components, elements, and steps within each embodiment may be used alone or in combination with any of the other embodiments and components, elements, and steps within the other embodiments.

Embodiment one may include an air pump assembly. The air pump assembly may comprise an impeller, a housing, and a diverter. The impeller may have an axial face and a circumferential periphery. The housing may surround the impeller, and may form a part or more of a primary passage. The primary passage may be open to the impeller at the axial face. The housing may have an inlet passage that may communicate with the primary passage. The inlet passage may have a longitudinal axis that may be arranged generally non-orthogonally with respect to an axis of rotation of the impeller. The diverter may be located partially or more within the inlet passage. The diverter may have a surface that may confront the axial face of the impeller, may confront the circumferential periphery of the impeller, or may confront both the axial face and the circumferential periphery. During use of the air pump assembly, the diverter may inhibit generation of turbulent flow between incoming fluid-flow and the impeller where the surface confronts the impeller.

Embodiment two, which may be combined with embodiment one, further describes that the air pump assembly may include a motor connected to the impeller to rotate the impeller about the axis of rotation during use of the air pump assembly.

Embodiment three, which may be combined with any one of embodiments one and two, further describes that the axial face may include a first axial face and a second axial face. The primary passage may include a first primary passage and a second primary passage. The first primary passage may be open to the impeller at the first axial face, and the second primary passage may be open to the impeller at the second axial face. The inlet passage may communicate with the first and second primary passages.

Embodiment four, which may be combined with any one of embodiments one, two, and three, further describes that the housing may include a body piece and a cover piece that are attached together.

Embodiment five, which may be combined with any one of embodiments one, two, three, and four, further describes that the diverter may be arranged generally axially with respect to the impeller, and that the surface may confront the circumferential periphery of the impeller and may confront substantially the full axial extent of the circumferential periphery.

Embodiment six, which may be combined with any one of embodiments one, two, three, four, and five, further describes that the axial face may include a first axial face and a second axial face. The primary passage may include a first primary passage and a second primary passage. The first primary passage may be open to the impeller at the first axial face, and the second primary passage may be open to the impeller at the second axial face. The inlet passage may include a first inlet passage and a second inlet passage. The first inlet passage may communicate with the first primary passage and the second inlet passage may communicate with the second primary passage. The first and second inlet passages may be defined in part by the diverter. The diverter may extend upstream beyond the first axial face with respect to incoming fluid-flow. A portion or more of turbulence which may be generated between incoming fluid-flow in the first inlet passage and the first axial face may be obstructed by way of the diverter and may not substantially impede incoming fluid-flow in the second inlet passage.

Embodiment seven, which may be combined with any one of embodiments one, two, three, four, five, and six, further describes that the diverter may include a first diverter and a second diverter, and that the surface of the diverter may include a first surface of the first diverter and a second surface of the second diverter. The first surface may confront a portion or more of the circumferential periphery of the impeller, and the second surface may confront a portion or more of the first axial face of the impeller.

Embodiment eight, which may be combined with any one of embodiments one, two, three, four, five, six, and seven, further describes that the impeller may have numerous vanes. The diverter may be arranged generally radially with respect to the impeller. The surface may confront a portion or more of the radial extent of the vanes.

Embodiment nine may include a method. The method may comprise providing an air pump assembly that may comprise an impeller and a housing. The housing may surround the impeller. The impeller may have numerous vanes and an axial face. The vanes may have a circumferential periphery. The housing may form a part or more of a primary passage, and the primary passage may be open to the vanes at the axial face. The housing may have an inlet passage that may communicate with the primary passage. The inlet passage may have a longitudinal axis that may be arranged generally axially with respect to the impeller. The method may further comprise diverting a portion or more of incoming fluid-flow traveling through the inlet passage away from the axial face of the impeller, away from the circumferential periphery of the vanes, or away from both the axial face and the circumferential periphery.

Embodiment ten, which may be combined with embodiment nine, further describes diverting a portion or more of incoming fluid-flow by way of a diverter that may be located partially or more within the inlet passage. The diverter may have a surface that may confront a portion or more of the axial extent of the circumferential periphery of the vanes.

Embodiment eleven, which may be combined with any one of embodiments nine and ten, further describes diverting a portion or more of incoming fluid-flow by way of a diverter that may be located partially or more within the inlet passage. The axial face may include a first axial face and a second axial face. The primary passage may include a first primary passage and a second primary passage. The first primary passage may be open to the impeller at the first axial face, and the second primary passage may be open to the impeller at the second axial face. The inlet passage may include a first inlet passage and a second inlet passage. The first inlet passage may communicate with the first primary passage and the second inlet passage may communicate with the second primary passage. The first and second inlet passages may be defined in part by the diverter. The diverter may extend upstream beyond the first axial face with respect to incoming fluid-flow. A portion or more of turbulence that may be generated between incoming fluid-flow in the first inlet passage and the first axial face may be obstructed by way of the diverter and may not substantially impede incoming fluid-flow in the second inlet passage.

Embodiment twelve, which may be combined with any one of embodiments nine, ten, and eleven, further describes diverting a portion or more of incoming fluid-flow by way of a diverter. The diverter may be located partially or more within the inlet passage. The diverter may have a surface that may confront a portion or more of the radial extent of the vanes at the axial face of the impeller.

Embodiment thirteen, which may be combined with any one of embodiments nine, ten, eleven, and twelve, further describes diverting a portion or more of incoming fluid-flow by way of a first diverter and a second diverter. The first diverter may be located partially or more within the inlet passage, and the second diverter may be located partially, or more within the inlet passage. The first diverter may have a first surface that may confront a portion or more of the axial extent of the circumferential periphery of the vanes, and the second diverter may have a second surface that may confront a portion or more of the radial extent of the vanes at the axial face of the impeller.

Embodiment fourteen, which may be combined with any of the previous embodiments one through thirteen, may include an air pump assembly. The air pump assembly may comprise an impeller, a motor, a housing, and a diverter. The impeller may have numerous vanes, a first axial face, and a second axial face. The vanes may have a circumferential periphery. The motor may be connected to the impeller in order to rotate the impeller when the air pump assembly is in use. The housing may surround the impeller. The housing may form a part or more of a first primary passage. The first primary passage may be open to the vanes at the first axial face. The housing may form a part or more of a second primary passage. The second primary passage may be open to the vanes at the second axial face. The housing may have an inlet passage that may communicate with the first and second primary passages. The inlet passage may have a longitudinal axis that may be arranged generally axially with respect to the impeller. The diverter may have a surface that may confront a portion or more of the axial extent of the circumferential periphery of the vanes by way of a radial space, may confront a portion or more of the radial extent of the vanes by way of an axial space, or may confront both.

The above description of embodiments of the invention is merely illustrative in nature and, thus, variations thereof are not to be regarded as a departure from the spirit and scope of the invention.

What is claimed is:

1. A product comprising:

an air pump assembly comprising:

an impeller having an axial face and a circumferential periphery;

a housing surrounding the impeller, the housing forming at least part of a primary passage for air flow, the primary passage being open to the impeller at the axial face, the housing having an inlet passage communicating with the primary passage, the inlet passage having a longitudinal axis arranged generally non-orthogonally with respect to an axis of rotation of the impeller and offset from a center of rotation of the impeller; and a diverter located at least partially within the inlet passage or the housing, the diverter comprising a second diverter and surface confronting the axial face of the impeller and a first diverter and surface confronting the circumferential periphery of the impeller, wherein the circumferential width of the first diverter and the second diverter is approximately equal to the diameter of the inlet passage; and wherein, during use of the air pump assembly, the diverter inhibits generation of turbulent flow between incoming air flow and the impeller where the surface confronts the impeller.

2. A product as set forth in claim 1 wherein the air pump assembly comprises a motor connected to the impeller to rotate the impeller about the axis of rotation during use of the air pump assembly.

3. A product as set forth in claim 1 wherein the axial face includes a first axial face and a second axial face, the primary passage includes a first primary passage and a second primary passage, the first primary passage being open to the impeller at the first axial face, the second primary passage being open to the impeller at the second axial face, the inlet passage communicating with the first and second primary passages.

4. A product as set forth in claim 1 wherein the housing comprises a body piece and a cover piece that are attached together.

5. A product as set forth in claim 1 wherein the diverter is arranged generally axially with respect to the impeller, and the surface confronts the circumferential periphery of the impeller and confronts substantially the full axial extent of the circumferential periphery.

6. A product as set forth in claim 1 wherein the axial face includes a first axial face and a second axial face, the primary passage includes a first primary passage and a second primary passage, the first primary passage being open to the impeller at the first axial face, the second primary passage being open to the impeller at the second axial face, the inlet passage includes a first inlet passage and a second inlet passage, the first inlet passage communicating with the first primary passage and the second inlet passage communicating with the second primary passage, the first and second inlet passages being defined in part by the diverter, the diverter extending upstream beyond the first axial face with respect to incoming air flow, wherein at least a portion of turbulence generated between incoming air flow in the first inlet passage and the first axial face is obstructed via the diverter and does not substantially impede incoming air flow in the second inlet passage.

7. A product as set forth in claim 1 wherein the impeller has a plurality of vanes, the diverter is arranged generally radially with respect to the impeller, and the surface confronts at least a portion of the radial extent of the plurality of vanes.

8. A product as set forth in claim 1 wherein the longitudinal axis of the inlet passage is arranged generally axially with respect to the impeller, and is arranged parallel with the axis of rotation of the impeller.

9. A method comprising:

providing an air pump assembly comprising an impeller and a housing surrounding the impeller, the impeller having a plurality of vanes and an axial face, the plurality of vanes having a circumferential periphery, the housing forming at least part of a primary passage, the primary passage being open to the plurality of vanes at the axial face, the housing having an inlet passage communicating with the primary passage, the inlet passage having a longitudinal axis arranged generally axially with respect to the impeller and wherein the inlet passage is offset from a center of rotation of the impeller; and providing a diverter at least partially within the inlet passage or the housing, the diverter comprising a second diverter and surface confronting the axial face of the impeller and a first diverter and surface confronting the circumferential periphery of the impeller, wherein the circumferential width of the first diverter and the second diverter is approximately equal to the diameter of the inlet passage, and diverting at least a portion of incoming air flow through the inlet passage away from the axial face of the impeller, away from the circumferential periphery of the plurality of vanes, or away from both the axial face and the circumferential periphery.

10. A method as set forth in claim 9 further comprising diverting at least a portion of incoming air flow via the diverter located at least partially within the inlet passage or the housing, wherein the axial face includes a first axial face and a second axial face, the primary passage includes a first primary passage and a second primary passage, the first primary passage being open to the impeller at the first axial face, the second primary passage being open to the impeller at the second axial face, the inlet passage includes a first inlet passage and a second inlet passage, the first inlet passage communicating with the first primary passage and the second inlet passage communicating with the second primary passage, the first and second inlet passages being defined in part by the diverter, the diverter extending upstream beyond the first axial face with respect to incoming air flow, wherein at least a portion of turbulence generated between incoming air flow in the first inlet passage and the first axial face is obstructed via the diverter and does not substantially impede incoming air flow in the second inlet passage.

11. A method as set forth in claim 9 further comprising diverting at least a portion of incoming air flow via a diverter located at least partially within the inlet passage or the housing, the diverter having a surface confronting at least a portion of the radial extent of the plurality of vanes at the axial face of the impeller.

12. A product comprising:

an air pump assembly comprising:

an impeller having a plurality of vanes, a first axial face, and a second axial face, the plurality of vanes having a circumferential periphery;

a motor connected to the impeller to rotate the impeller during use of the air pump assembly;

a housing surrounding the impeller, the housing forming at least part of a first primary passage, the first primary passage being open to the plurality of vanes at the first axial face, the housing forming at least part of a second primary passage, the second primary passage being open to the plurality of vanes at the second axial face, the housing having an inlet passage communicating with the first and second primary passages, the inlet passage having a longitudinal axis arranged generally axially with respect to the impeller and wherein the inlet passage is offset from a center of rotation of the impeller; and a diverter located at least partially within the inlet passage or the housing comprising a second diverter and surface confronting the axial face of the impeller and a first diverter and surface confronting the circumferential periphery of the impeller, wherein the circumferential width of the first diverter and the second diverter is approximately equal to the diameter of the inlet passage.

* * * * *